United States Patent [19]

Brandes

[11] Patent Number: 4,531,108

[45] Date of Patent: Jul. 23, 1985

[54] THREE-PHASE CHOKE WITH A FIVE-LEG CORE

[75] Inventor: Donald Brandes, Filderstadt, Fed. Rep. of Germany

[73] Assignee: Transformation Union Aktiengesellschaft, Stuttgart, Fed. Rep. of Germany

[21] Appl. No.: 581,322

[22] Filed: Feb. 17, 1984

[30] Foreign Application Priority Data

Feb. 18, 1983 [DE] Fed. Rep. of Germany ..... 3305708

[51] Int. Cl.[3] ..... H01F 33/00; H01F 27/24

[52] U.S. Cl. ..... 336/5; 336/178; 336/210; 336/212; 336/215

[58] Field of Search ..... 336/178, 212, 210, 214, 336/215, 100, 5, 10, 12, 219

[56] References Cited

FOREIGN PATENT DOCUMENTS

| | | | |
|---|---|---|---|
| 2728904 | 1/1979 | Fed. Rep. of Germany | 336/212 |
| 2805330 | 8/1979 | Fed. Rep. of Germany | 336/210 |
| 3040742 | 6/1982 | Fed. Rep. of Germany | 336/212 |
| 88308 | 7/1981 | Japan | 336/178 |

OTHER PUBLICATIONS

Die Transformatoren, Rudolf Küchler, Grundlagen Für ihre Berechnung und Konstruktion, Springer-Verlag, New York 1966, pp. 38–41.

*Primary Examiner*—Thomas J. Kozma

*Attorney, Agent, or Firm*—Herbert L. Lerner; Laurence A. Greenberg

[57] ABSTRACT

A three-phase choke, includes a five-leg core formed of a central core leg carrying a winding, two outer core legs each carrying a winding and two return legs, the central and outer core legs being formed of stacks of laminations, a lower yoke having ends adjacent the return legs, an upper yoke formed of sections having ends defining gaps between the ends of the sections and gaps between the return legs and the ends of the sections of the upper yoke adjacent thereto, and non-magnetic material filling the gaps, the yokes and return legs having cross sections being smaller than the cross sections of the core legs carrying a winding, each of the return legs and the ends of the yokes adjacent thereto having a first magnetic resistance, the upper yoke having a respective portion thereof disposed between the central core leg and each of the outer core legs each having a second magnetic resistance, and the lower yoke having a respective portion thereof disposed between the central core leg and each of the outer core legs each having a third magnetic resistance, the magnetic resistances being substantially determined by the thickness of the gaps, and the sum of one of the second and one of the third magnetic resistances being greater than one of the first magnetic resistances.

4 Claims, 2 Drawing Figures

THREE-PHASE CHOKE WITH A FIVE-LEG CORE

Figure 1:
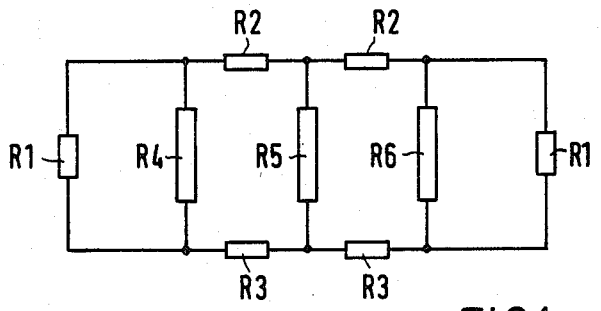

The invention relates to a three-phase choke with a five-leg core, having three core legs wearing windings and constructed of lamination stacks, gaps filled with non-magnetic material, and yokes and return legs having cross sections which are reduced in size as compared to the cross section of the wound core legs.

In electric power supply networks, chokes are used for compensating capacitive reactive power. Single-phase chokes are frequently used for high voltages and for large amounts of reactive power. A more economical construction is often possible through the use of three-phase chokes, because such chokes require a smaller investment in the cost of the choke itself as well as for its installation in a system.

If a zero-phase sequence impedance which is as low as in single-phase chokes is required, it is advantageous to use a three-phase choke with a five-leg core as a structural unit. Similar to large transformers with five-leg cores, in this case three core legs are wound and the unwound outer legs serve as magnetic returns. This fully assures the inductivities of the choke in the event of asymmetrical voltage conditions.

German Published, Non-Prosecuted application DE-OS 27 28 904, describes a three-phase transformer with choke-like behavior due to a large stray flux component. In this transformer, three core legs are wound and are provided with ends which are connected to each other for carrying the magnetic flux. The general usability of five-leg cores in which the cross-sectional areas of the core legs are related to those of the yokes and the return legs in a ratio of 1.73 to 1, is known from chapter I, No. 7 entitled "Der Fünfschenkelkern für Drehstrom" (The five-leg core for three-phase current) in the book entitled "Die Transformatoren" (The transformers) by Rudolf Küchler. The wound core legs for chokes in such a device are constructed from laminations stacks which include gaps filled with nonmagnetic material, according to German Published, Non-Prosecuted application DE-OS 30 40 742 or DE-OS 30 40 724.

Under these conditions with continuous yokes, the stresses in the yoke sections between the wound legs on one hand and the return legs on the other hand, differ greatly in a choke with a five-leg core. The yoke sections are pure iron paths and therefore have a very low magnetic resistance or reluctance. Even if the return legs are well interleaved with the yoke laminations, local saturation comes about at the interleaving point, so that the resistance of the return is relatively high as compared to that of the yoke sections. As a result, the magnetic flux is closed by the yokes and leads to high inductions therein and therefore also leads to large losses. These conditions are even worse if the upper yoke is moveable to provide for clamping the legs, because a non-magnetic gap then exists between the respective return leg and the upper yoke beam. This adjustability is also desirable for noise considerations.

It is accordingly an object of the invention to provide a three-phase choke with a five-leg core, which overcomes the hereinaforementioned disadvantages of the heretofore-known devices of this general type, and to force a predetermined distribution of the magnetic flux in the individual yoke sections and in the return yokes in a five-leg core, with optimized iron cross sections for three-phase chokes and with core legs carrying non-magnetic gaps in windings.

With the foregoing in view there is provided, in accordance with the invention, a three-phase choke, comprising a five-leg core formed of a central core leg, wearing a winding two wound outer core legs each wearing a winding and two return legs, the wound central and outer core legs being formed of stacks of laminations, a lower yoke having ends adjacent the return legs, an upper yoke formed of sections having ends defining gaps between the ends of the sections and gaps between the return legs and the ends of the sections of the upper yoke adjacent thereto, and non-magnetic material filling the gaps, the yokes and return legs having cross sections being smaller than the cross sections of the wound core legs, each of the return legs and the ends of the yokes adjacent thereto having a first magnetic resistance, the upper yoke having a respective portion thereof disposed between the central core leg and each of the outer core legs each having a second magnetic resistance, and the lower yoke having a respective portion thereof disposed between the central core leg and each of the outer core legs each having a third magnetic resistance, the magnetic resistances being substantially determined by the thickness of the gaps, and the sum of one of the second and one of the third magnetic resistances being greater than one of the first magnetic resistances.

In accordance with another feature of the invention, the sum of one of the second and one of the third magnetic resistances is substantially twice as high as one of the first magnetic resistances, producing magnetic fluxes of equal magnitude in the yokes and return legs.

In accordance with a further feature of the invention, at least the upper yoke is subdivided into three yoke sections of substantially equal size each being associated with one of the core legs, and including axial clamping devices, each individually holding a respective one of the yoke sections in place.

In accordance with an added feature of the invention, each of the clamping devices is in the form of, or includes, a tie rod centered in a respective core leg for taking up tension forces parallel to the core legs. A common clamping structure for the three yoke parts disposed in vicinity of the yoke gap, inserts a non-magnetic material, which may be formed of chrome nickel steel, in order to avoid a preferential conduction of the flux and resultant large eddy current losses.

In accordance with a concomitant feature of the invention, the yoke sections are clamped to the return legs.

Three-phase chokes constructed in accordance with the invention are very advantageous because the flux distribution of the magnetic flux can be adjusted optimally with the additional gaps filled with non-magnetic material, and because in addition, each of the core legs with the associated winding or windings can be optimally clamped by itself. The additional gaps then only influence the inductivity of the three-phase choke to a relatively slight degree, because together they are much smaller than the sum of the gaps within the at least one winding carrying core legs between the lamination stacks forming the core legs. The axial tension which can be largely independently adjusted at the individual core legs, is of particular advantage in view of the low-noise construction of chokes.

Other features which are considered as characteristic for the invention are set forth in the appended claims.

Although the invention is illustrated and described herein as embodied in a three-phase choke with a five-leg core, it is nevertheless not intended to be limited to the details shown, since various modifications and structural changes may be made therein without departing from the spirit of the invention and within the scope and range of equivalents of the claims.

Figure 2:
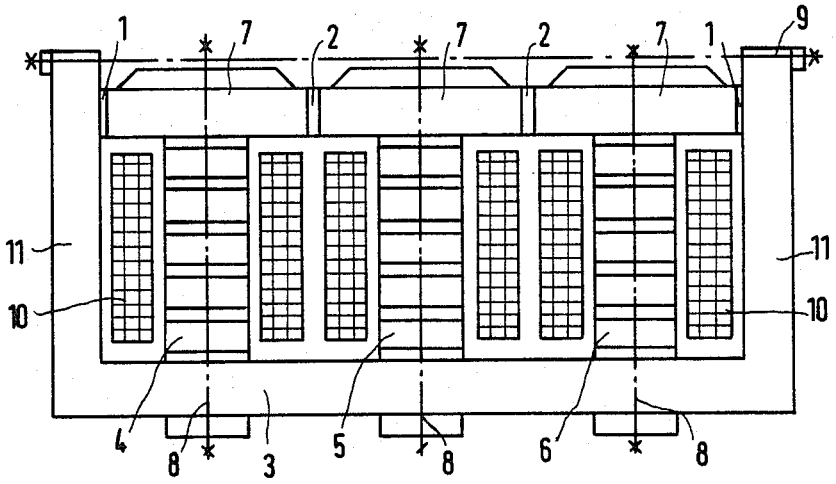

The construction and method of operation of the invention, however, together with additional objects and advantages thereof will be best understood from the following description of specific embodiments when read in connection with the accompanying drawings, in which:

FIG. 1 is a schematic circuit diagram illustrating the distribution of magnetic resistances or reluctances, equivalent to the choke of FIG. 2; and FIG. 2 is a diagrammatic longitudinal sectional view of a three-phase choke with a five-leg core, corresponding to the diagram of FIG. 1.

Referring now to the figures of the drawing in detail and first particularly to FIG. 1 thereof, there are seen functional connections of the different magnetic resistances or reluctances of a three-phase choke with a five-leg core. In FIG. 1, the magnetic resistances or reluctances R4, R5 and R6 of wound core legs 4, 5 and 6 are of the same magnitude. Magnetic resistances or reluctances R3 which are formed by parts of the lower yoke, and magnetic resistances or reluctances R2 formed by parts of the upper yoke, are disposed between the ends of the core leg 5 and the ends of the core legs 4 and 6. The return legs of the five-leg core are formed by magnetic resistances or reluctances R1. The magnetic resistances or reluctances R1, R2 and R3 are considerably smaller than the magnetic resistances or reluctances R4, R5 and R6.

By virtue of this construction, at least one of the magnetic resistances or reluctances R2 and R3 are each connected in series in one possible closed magnetic flux circuit with the magnetic resistances or reluctances R4, R5 and R6. On the other hand, each one of the magnetic resistances or reluctances R1 is connected by itself in series with one of the magnetic resistances or reluctances R4 and R6, respectively.

FIG. 2 shows core legs 4, 5 and 6 in a U-shaped frame which is constructed of a lower yoke and return legs 11. Each of the core legs carries a winding 10. The core legs 4, 5 and 6 are formed in the usual manner of lamination stacks, between which gaps are provided and filled with a non-magnetic material for determining the magnetic resistance or reluctance represented by them.

One of three yoke sections 7, which together form an upper yoke, is disposed above each core leg 4, 5 and 6. The gaps 2 provided between the yoke sections 7 are twice as large as the corresponding gaps 1 between the upper ends of the return legs 11 and the yoke sections adjacent thereto. Inserts of non-magnetic material are placed in the gaps 1 and 2.

The mechanical cohesion of this structure is assured in the usual manner by diagrammatically illustrated clamping devices or tie rods 8, for the windings 10 and the core legs 4, 5 and 6 as well as by an additional diagrammatically illustrated clamping device 9 which acts essentially in the longitudinal direction of the upper yoke. The clamping device 9 simultaneously holds the inserts in the gaps 1 and 2.

The location and shape of the gaps 1 and 2 cause a magnetic flux driven by the windings 10 through the core legs 4, 5 and 6 to be distributed in the desired manner over the yoke sections 7, the return legs 11 and the lower yoke 3, in such a manner that super-saturation in the individual iron parts carrying the magnetic flux is precluded and in addition, provides an optimum magnitude for the losses produced in the iron caused by the forced division of the flux.

The foregoing is a description corresponding in substance to German application P 33 05 708.7, filed Feb. 18, 1983, the International priority of which is being claimed for the instant application, and which is hereby made part of this application. Any material discrepancies between the foregoing specification and the aforementioned corresponding German application are to be resolved in favor of the latter.

What is claimed is:

1. Three-phase choke, comprising a five-leg core formed of a central core leg having a winding disposed thereon, two outer core legs each having a respective winding disposed thereon and two return legs, said central and outer core legs being formed of stacks of laminations, a lower yoke having ends adjacent said return legs, an upper yoke formed of sections having ends defining gaps between said ends of said sections, and gaps between said return legs and said ends of said sections of said upper yoke adjacent thereto, nonmagnetic material filling said gaps, at least said upper yoke being subdivided into three yoke sections of substantially equal size each being associated with one of said core legs, and axial clamping devices each individually holding a respective one of said yoke sections on place, said yokes and return legs having cross sections being smaller than the cross sections of said core legs, each of said return legs and said ends of said yokes adjacent thereto having a first magnetic resistance, said upper yoke having a respective portion thereof disposed between said central core leg and each of said outer core legs each having a second magnetic resistance, and said lower yoke having a respective portion thereof disposed between said central core leg and each of said outer core legs each having a third magnetic resistance, said magnetic reistances being substantially determined by the thickness of said gaps, and the sum of one of said second and one of said third magnetic resistances being greater than one of said first magnetic resistances.

2. Three-phase choke according to claim 1, wherein the sum of one of said second and one of said third magnetic resistances is substantially twice as high as one of said first magnetic resistances, producing magnetic fluxes of equal magnitude in said yokes and return legs.

3. Three-phase choke according to claim 2, wherein each of said clamping devices is in the form of a tie rod centered in a respective core leg for taking up tension forces parallel to said core legs.

4. Three-phase choke according to claim 3, wherein said yoke sections are clamped to said return legs.

* * * * *